US008025243B2

(12) United States Patent
Charpie

(10) Patent No.: US 8,025,243 B2
(45) Date of Patent: Sep. 27, 2011

(54) CORDLESS SPRAY GUN WITH AN ON-BOARD COMPRESSED AIR SOURCE

(75) Inventor: Mark E. Charpie, Ottawa Lake, MI (US)

(73) Assignee: Illinois Tool Works Inc., Glenview, IL (US)

( * ) Notice: Subject to any disclaimer, the term of this patent is extended or adjusted under 35 U.S.C. 154(b) by 725 days.

(21) Appl. No.: 11/957,041

(22) Filed: Dec. 14, 2007

(65) Prior Publication Data

US 2009/0152382 A1 Jun. 18, 2009

(51) Int. Cl.
*B05B 9/04* (2006.01)

(52) U.S. Cl. ..... 239/332; 239/214; 239/379; 239/345; 239/526; 222/333

(58) Field of Classification Search ..... 239/153, 239/154, 268, 332, 345, 379, 529, 214, 526; 222/333

See application file for complete search history.

(56) References Cited

U.S. PATENT DOCUMENTS

| | | | | |
|---|---|---|---|---|
| 1,881,570 | A * | 10/1932 | Hermann | 239/290 |
| 4,030,665 | A * | 6/1977 | Koyama | 239/373 |
| 4,605,993 | A * | 8/1986 | Zelina, Jr. | 362/183 |
| 5,131,598 | A * | 7/1992 | Hoogeveen, Jr. | 239/223 |
| 5,211,171 | A * | 5/1993 | Choromokos | 128/205.19 |
| 6,350,040 | B1 * | 2/2002 | Parker | 362/183 |
| 7,303,149 | B1 * | 12/2007 | Huang | 239/332 |
| 2004/0251321 | A1 * | 12/2004 | Ye et al. | 239/526 |
| 2005/0284963 | A1 | 12/2005 | Reedy | |
| 2006/0219824 | A1 * | 10/2006 | Alexander et al. | 239/690 |
| 2008/0272150 | A1 | 11/2008 | Hahn et al. | |

FOREIGN PATENT DOCUMENTS

| | | |
|---|---|---|
| FR | 675417 | 2/1930 |
| FR | 2082636 | 12/1971 |

* cited by examiner

*Primary Examiner* — Dinh Nguyen
(74) *Attorney, Agent, or Firm* — Fletcher Yoder

(57) ABSTRACT

A system, in certain embodiments, may include a spray coating device having a self-contained air system. The self-contained air system is adapted to supply a desired amount of air pressure within the spray coating device. Further, the self-contained air system comprises only an air blower rendering the spray coating device air tank-less.

20 Claims, 6 Drawing Sheets

CORDLESS SPRAY GUN WITH AN ON-BOARD COMPRESSED AIR SOURCE

BACKGROUND

The present technique relates generally to spray application devices, such as spray guns, lawn sprayers, and so forth used to apply atomized liquids. More specifically, the present technique relates to a cordless atomizing device.

Spray coating devices, otherwise known as spray guns, typically receive fluid, such as paint fluid, and compressed air from external air and fluid sources coupled to the spray gun. There are several types of spray guns having various operating mechanism, such as suction feeding, gravity feeding or pressurized feeding mechanisms. In addition, any one or more of the aforementioned spray guns may be powered by an external power source adapted to deliver electrical power for operating the spray gun. For example, the external power source may include a power generator, a power grid, and the like. The aforementioned fluid and air sources may include canisters, tanks, pressure pots, and so forth. Extensions, such as hoses, tubing, cords, and so forth, are also used to couple the fluid and air sources to the spray gun. However, these extensions may limit the user's ability to move and maneuver throughout the spray coating operation. In addition, while operating the spray gun with cords and hoses coupled thereto, the user has to be constantly mindful of the location of the cords and hoses so as to not fall or stumble on these while using the spray gun. In addition, hoses connecting the spray gun to its air fluid and/or electrical supplies, such as those disposed on a vehicle, may get stuck or caught under tires of the vehicle. This may interrupt the spray coating operation, as the user may need to stop and release the hoses from the tire(s) of the vehicle. Moreover, in maneuvering and releasing the hoses, dirt and other contaminants that may have gotten stuck or attached onto the hoses may find their way into the atmosphere as dust particles landing on the freshly painted surface. This may require the user to sand and buff the imperfection out of the paint job, thus, increasing the length and cost of the spray coating operation.

In addition, the physical connectedness between the aforementioned fluid and air sources and the spray gun can limit the mobility and versatility of the user during the spray coating operation. To the extent such user mobility is compromised, the user may not be able to, for example, apply paint uniformly across certain surfaces, thereby lowering the overall quality and/or efficiency of the spray coating operation. In addition, the hoses and/or tubing attached to the spray gun may have substantial weight, further burdening the user during the spray coating operation.

BRIEF DESCRIPTION

A system, in certain embodiments, may include a cordless spray coating device, i.e., spray gun having an on-board power, air and fluid supply. In one embodiment, the spray coating device comprises a body, a spray head coupled to the body and a liquid passage extending through the body, the spray head, or a combination thereof, such that the liquid passage is configured to receive the coating fluid. Additionally, the spray gun comprises an air passage extending through the body, the spray head, or a combination thereof, such that the air passage is configured to receive an air supply. The spray gun further comprises an air flow generator mounted to the body, the spray head, or a combination thereof, wherein the air flow generator is a non-reciprocating device. In another embodiment, a cordless spray gun is provided in which a tankless air system having an air flow generator is mounted directly to, or is an integral part of, the spray coating device.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
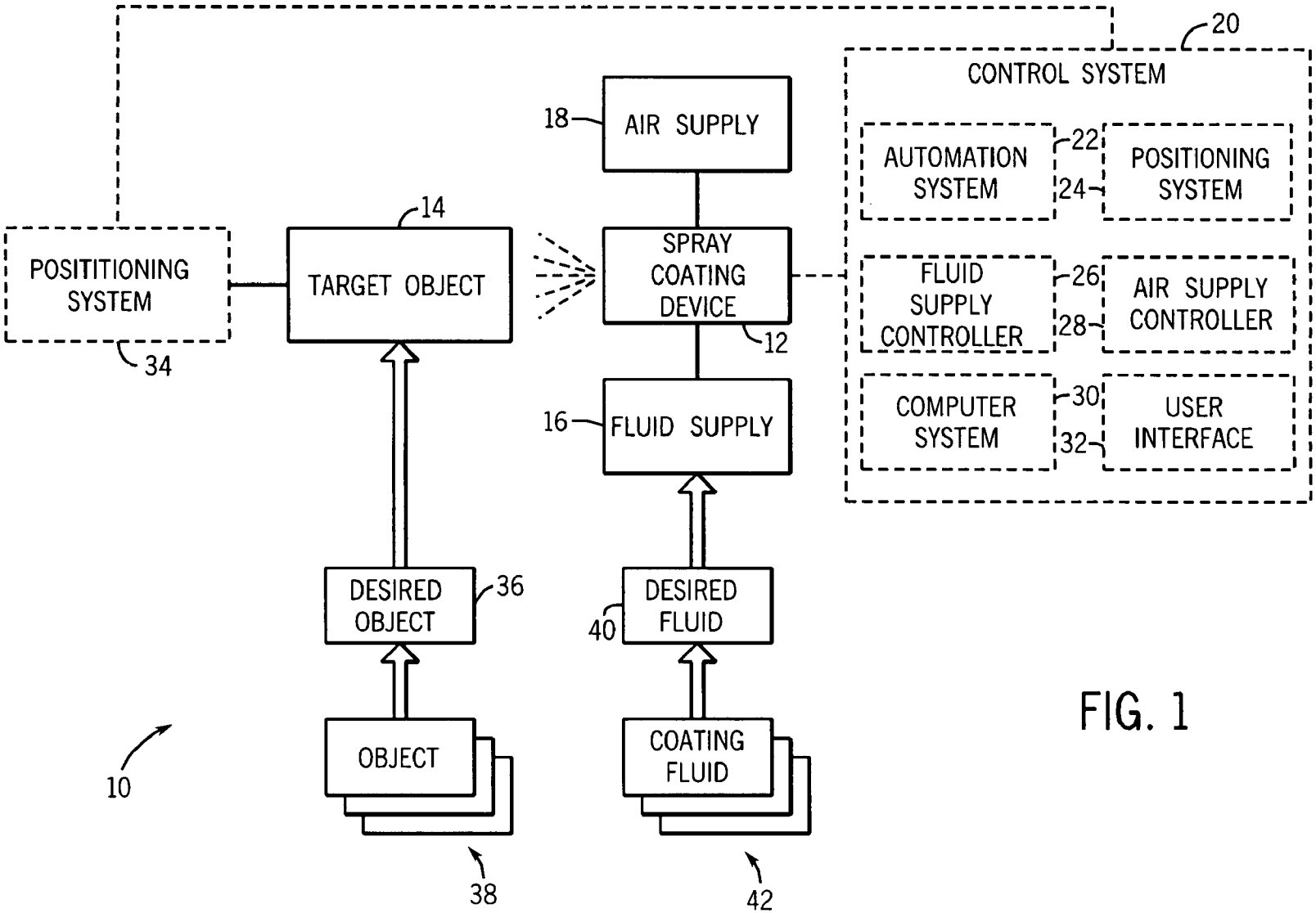
FIG. 1 is a diagram illustrating an embodiment of a spray coating system.

FIG. 1 is a flow chart illustrating an embodiment of a spray coating system 10, which includes a cordless spray coating device 12 (e.g., spray gun) for applying a desired coating to a target object 14. For simplicity, the cordless spray coating device 12 will be described as a spray gun in the following description, although various embodiments of the cordless spray coating device 12 may or may not have a gun-shaped body. As will be discussed in further detail below, embodiments of the spray gun 12 have on-board air, fluid, and power supplies. The air supply of the spray gun 12 may include an air blower disposed within the spray gun 12. The air blower is adapted to intake outside air and, thereafter, to channel the air through the spray gun 12. Accordingly, the air then mixes with spray fluid to form an atomized spray pattern. As shown further below, the air intake system of the spray gun 12 does not require compressors and/or on-board pressurized tanks for countering and stabilizing air pressure within the spray gun 12. Such an air tank is required to stabilize pulsations in a typical reciprocating compressor, such as a piston-cylinder compressor. However, an air blower, rotary screw compressor, or non-reciprocating compressor may provide generally uniform flow of compressed air without a stabilizing tank. Advantageously, these and other similar air systems eliminate pollutants, such as oil vapors, pipe scale, rust, and so forth which otherwise need to be filtered when compressors are incorporated with conventional spray guns. The air blower and/or other components of the spray gun 12 may be powered by an on-board motor coupled to an on-board battery, both of which are disposed within the spray gun 12. The cordless spray gun 12 may include other components, such as atomization and air-fluid mixing mechanisms. These may include, for example, a rotary atomizer module, an air assisted atomizer module, or a fluid-only atomizer modular (e.g., without air assistance). The spray gun 12 may also be configured to support a plurality of alternative air heads, which may include different types of air shaping jets configured to provide different shapes of sprays. Another example would be a plurality of different types of valves, such as a spring-assisted valve or an air-assisted valve. These and other features of the spray gun 12 are discussed in further detail below with reference to FIGS. 3-6.

Further, in certain embodiments, the illustrated cordless spray gun 12 operates as an autonomous self sustained unit having no cords, hoses and/or tubing coupled thereto. Accordingly, the spray gun 12 may be relatively light in weight and less cumbersome to move around during spray coating operations. This provides the user with a desired flexibility to easily carry and maneuver the spray gun 12 during the spray coating operation. For example, the user may have an ability to spray coat surfaces which may be hard to reach or are otherwise inaccessible with a spray gun having cords, hoses, etc. This enables the user to evenly apply spray coats across obscure surfaces and/or surfaces having complex shapes and designs. Further, the on-board spray fluid tank of the spray gun 12 may be easily interchangeable so that the user can quickly swap between different kinds of spray fluids. For example, the spray gun 12 enables the user to efficiently switch between spray paints having different colors and/or textures. This may improve overall efficiency and quality of the spray coating operation.

The spray gun 12 may be coupled to a variety of supply and control systems, such as a fluid supply 16, an air supply 18, and a control system 20. The control system 20 facilitates control of the fluid and air supplies 16 and 18 and ensures that the spray gun 12 provides an acceptable quality spray coating on the target object 14. For example, the control system 20 may include an automation system 22, a positioning system 24, a fluid supply controller 26, an air supply controller 28, a computer system 30, and a user interface 32. The control system 20 also may be coupled to a positioning system 34, which facilitates movement of the target object 14 relative to the spray gun 12. Accordingly, the spray coating system 10 may provide a computer-controlled mixture of coating fluid, fluid and air flow rates, and spray pattern. Moreover, the positioning system 34 may include a robotic arm controlled by the control system 20, such that the spray gun 12 covers the entire surface of the target object 14 in a uniform and efficient manner. In a cordless configuration, such as the one provided by the spray gun 12, the above mentioned control and positioning system may be coupled to the spray gun 12 via wireless devices. In some embodiments, all or part of the control system 20 may be disposed on-board in the spray gun 12.

Spray coating system 10 of FIG. 1 is applicable to a wide variety of applications, fluids, target objects, and types/configurations of the spray gun 12. For example, the user may couple to the spray gun 12 a variety of fluid canisters having a desired fluid 40 from a plurality of different coating fluids 42, which may include different coating types, colors, textures, and characteristics for a variety of materials such as metal and wood. The user also may select a desired object 36 from a variety of different objects 38, such as different material and product types. The spray gun 12 also may comprise a variety of different components and spray formation mechanisms to accommodate target object 14 and fluid supply 16 selected by the user. For example, the spray gun 12 may comprise an air atomizer, a rotary atomizer, an electrostatic atomizer, or any other suitable spray formation mechanism.

Figure 2:
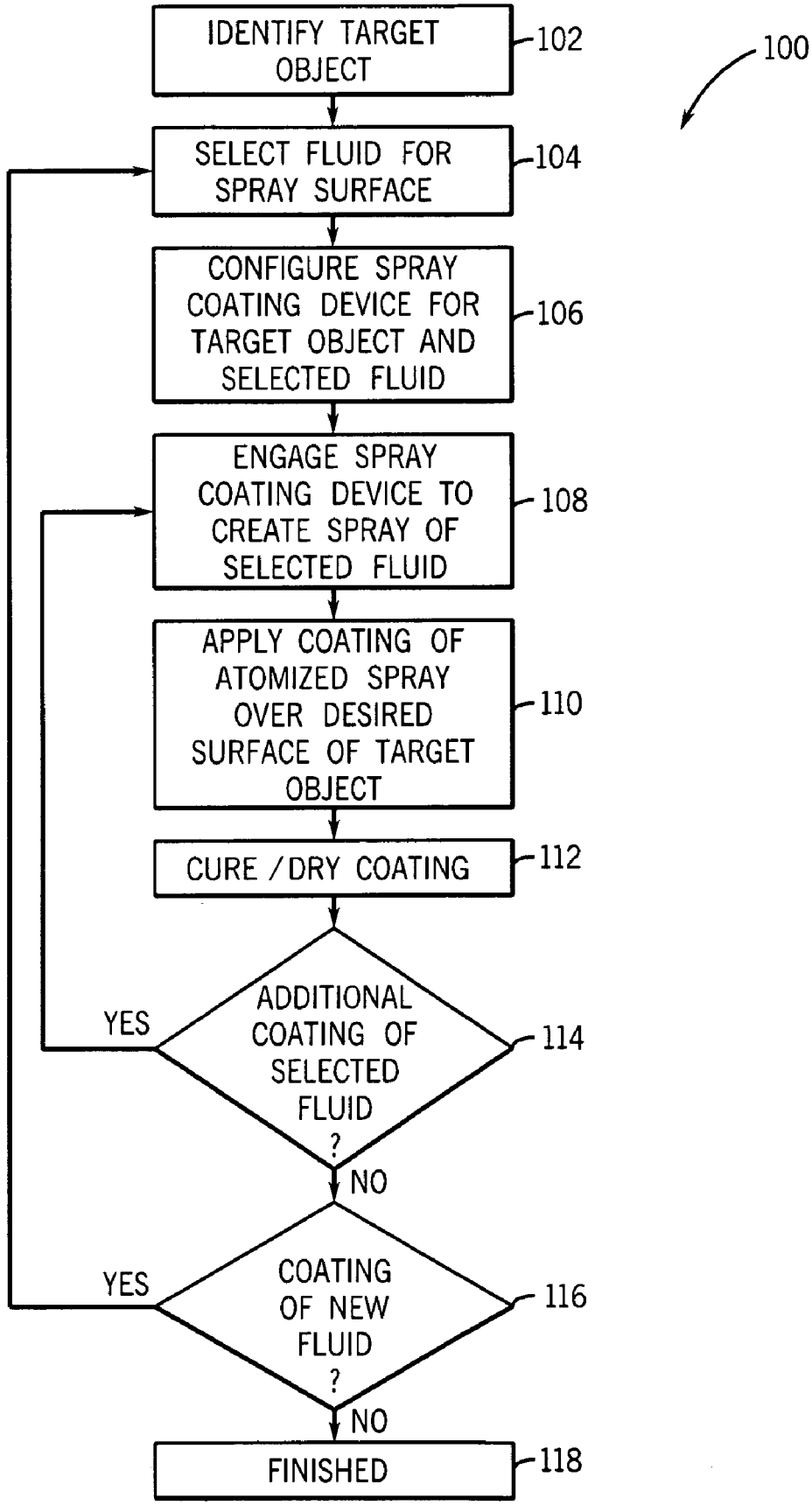
FIG. 2 is a flow chart illustrating an embodiment of a spray coating process.

FIG. 2 is a flow chart of an embodiment of a spray coating process 100 for applying a desired spray coating to the target object 14. As illustrated, process 100 proceeds by identifying target object 14 for application of the desired fluid (block 102). Process 100 then proceeds by selecting desired fluid 40 for application to a spray surface of the target object 14 (block 104). A user may then proceed to configure spray gun 12 for the identified target object 14 and selected fluid 40 (block 106). As the user engages spray gun 12, process 100 then proceeds to create an atomized spray of selected fluid 40 (block 108). Block 108 may include engaging an on-board air blower, or rotary screw compressor, to facilitate operation of a valve, atomize a fluid, shape a spray, or a combination thereof. The user may then apply a coating of the atomized spray over the desired surface of target object 14 (block 110). Process 100 then proceeds to cure/dry the coating applied over the desired surface (block 112). If an additional coating of selected fluid 40 is desired by the user at query block 114, then process 100 proceeds through blocks 108, 110, and 112 to provide another coating of the selected fluid 40. If the user does not desire an additional coating of the selected fluid at query block 114, then process 100 proceeds to query block 116 to determine whether a coating of a new fluid is desired by the user. If the user desires a coating of a new fluid at query block 116, then process 100 proceeds through blocks 104-114 using a new selected fluid for the spray coating. If the user does not desire a coating of a new fluid at query block 116, then process 100 is finished at block 118.

Figure 3:
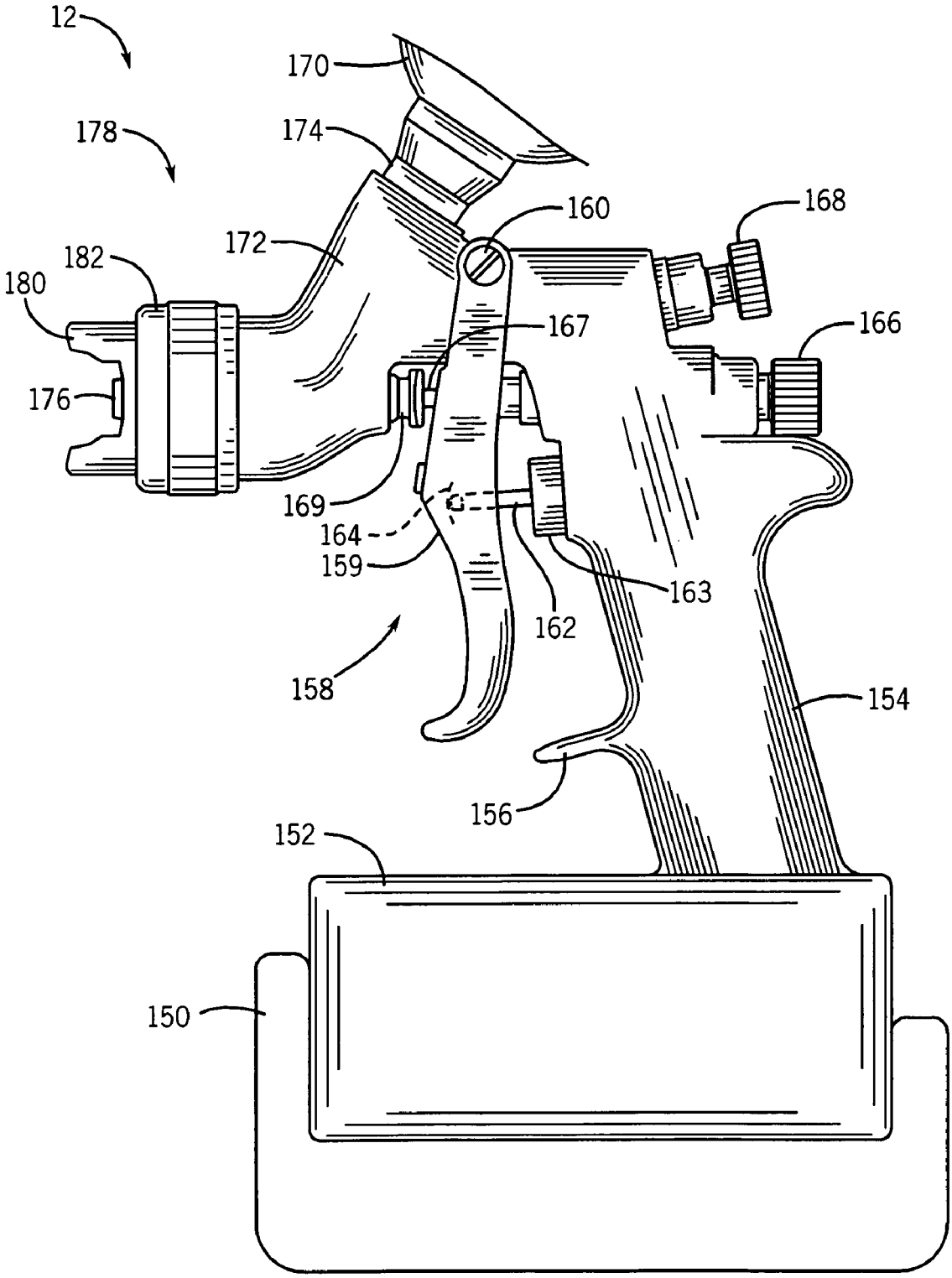
FIG. 3 is a side view of an embodiment of a spray coating device coupled to a docking station.

FIG. 3 is a side view of the spray gun 12 in accordance with an embodiment of the present technique. As illustrated, the spray gun 12 is coupled to a docking station 150. The docking station 150 provides a resting place for the spray gun 12, and is adapted to recharge a battery of the spray gun 12 while the spray gun 12 is not in operation, i.e., between spray coating operations. Accordingly, the docking station 150 may include an electrical interface, such as a transformer, adapted to receive and convert, for example, external AC power into DC power. For instance, the docking station may couple to a wall or a generator outlet providing external 120V AC which may be converted by the docking station 150 into 24 V DC used for charging the on-board battery of spray gun 12. The docking station 150 and the spray gun 12 may include male-female matching pins adapted to electrically couple the docking station 150 and the spray gun 12. The docking station 150 may further be adapted to securely retain the spray gun 12 in place while the spray gun 12 is not operating. In this manner, the docking station 150 may serve as a holder for the spray gun 12, thus, preventing unnecessary movements which could potentially break or otherwise damage the spray gun 12. Alternatively, in another exemplary embodiment, the docking station 150 may include a separate charger adapted to recharge the battery of the spray gun 12 while the spray gun itself is not placed in or on the charger 150. In such an embodiment, the spray gun 12 may include a replaceable rechargeable battery adapted to be charged by the separated battery charger. Accordingly, such a battery may be adapted to slide out of the spray gun 12 so that it can be attached and recharged by the battery charger 150. Thus, during the spraying operation, the user may replace drained batteries with those that have been charged, thereby enabling the user to use the spray gun 12 for prolonged durations. In addition, having a separate charger, such as the charger 150, enables charging only the batteries of the spray gun 12 away from a paint room where spray fluids and other volatile chemical are stored. This enhances the proper and safe use of the spray gun 12.

As further illustrated, spray gun 12 includes a base enclosure 152 coupled to a handle 154. The enclosure 152 is adapted to house on-board components of the spray gun 12. As describe in fuller detail below, these components may include, for example, a battery, a motor, an air blower, and an air filter. The components also may include an on-board controller, such as a motor controller, a valve controller, a spray controller, and so forth. The on-board controller may include memory, a processor, and code stored on the memory and executable by the processor. The components also may include a wireless communications module. These on-board components facilitate the cordless feature of the spray gun 12, providing the user with robust flexibility for performing spray coating operations. Further, the handle 154 includes a gripping rib 156 enabling the user to rest his/her fingers during usage of the spray gun 12. In this manner, the gripping rib 156 enables the user to comfortably grip and use the spray gun 12 for prolonged periods of time.

The spray gun 12 further includes a trigger assembly 158 adapted to actuate flow of fluid and/or air into the spray gun 12. The trigger assembly 158 includes a trigger 159 coupled to a pivot joint 160. Accordingly, the trigger 159 is movable, i.e., rotatable about the pivot joint 160. The trigger assembly 158 further includes a movable needle 162 emanating from a switch 163 coupled to handle 154. The needle 162 is adapted to press against a needle stop 164 disposed within an interior portion of the trigger 159. The moveable needle 162 is adapted to actuate the switch 163 as the user squeezes the trigger 159. In the illustrated embodiment, the movable needle 162 may be fully extended so that the needle 162 may lightly press the needle stop 164 when the trigger 159 is unsqueezed. As further shown below, the movable needle 162 may be adapted to regulate electrical power for producing and channeling air flow within the spray gun 12. In addition, the switch 163 may be coupled to fluid regulating and channeling components disposed within the spray gun 12. For example, the switch 163 may be coupled to fluid valves and/or conduits adapted to increase or lower fluid flow within the spray gun 12. Hence, as the user squeezes the trigger 159, the needle stop 164 presses on the movable needle 162, causing the movable needle 162 to move inward into the handle 154. In so doing, the movable needle 162 can be used to control and regulate the operation of the aforementioned air producing and fluid control components. It should also be noted that the amount of pull a user applies to the trigger 159 could control the speed of the blower disposed within the spray gun 12. Thus, for example, the greater the pull the user applies to the trigger 159 the faster the blower operates.

The spray gun 12 further includes a needle adjusting screw 166 adapted to control a fluid needle valve 167 disposed within the spray gun 12. The needle adjusting screw 166 can be rotated in and out for controlling movements of the fluid needle valve 167. This may be used to control the amount of fluid flowing and exiting the spray gun 12. As further illustrated, the spray gun 12 includes a spreader adjusting screw 168 adapted to control the spray pattern, for example, from a long narrow to a round pattern. The screw 168 also controls the air pressure balance between atomization and pattern shaping air.

The spray gun 12 further includes a fluid needle gland 169 adapted for enabling motion of the fluid needle valve 167 between front and rear portions of the spray gun 12. Hence, as the fluid needle valve 167 moves backwards, spray fluid is channeled from an on-board fluid canister 170 into a front portion 172 of the spray gun 12. As illustrated, canister 170 is coupled from above to the spray gun 12 via a fluid inlet adapter 174. In the illustrated embodiment, the spray gun 12 utilizes a gravity-assisted fluid-feeding mechanism, whereby fluid drops into the front portion 172. Once the spray fluid enters the portion 172, then the fluid flows toward exit tip 176 where it forms a spray coating. Other embodiments of the spray gun 12 may include other types of fluid-feeding mechanisms, such as those adapted to provide the spray gun 12 pressurized spray fluid, for example via pumps, pressurized tanks and so forth. Moreover, the fluid may be fed from the bottom of the spray gun 12 rather than the top if suction pressure is used to flow the fluid into the spray gun. In some embodiments, the air blower may supply pressure to flow the coating fluid into the spray gun.

The spray gun 12 further includes a spray head 178, which includes the exit tip 176, an air cap 180, and a retaining ring 182. The air cap 180 may include various atomization mechanisms for producing various spray profiles of the spray fluid. Accordingly, the air cap 180 and/or additional components of the spray head 178 may be replaceable. For instance, the retaining ring 182 adapted to secure the spray head 178 to front portion 172, can be unfastened for loosening and replacing the air cap 180. The retaining ring 182 further enables the user to easily remove and clean the spray head 178, as well as additional component of the spray gun 12.

Figure 4:
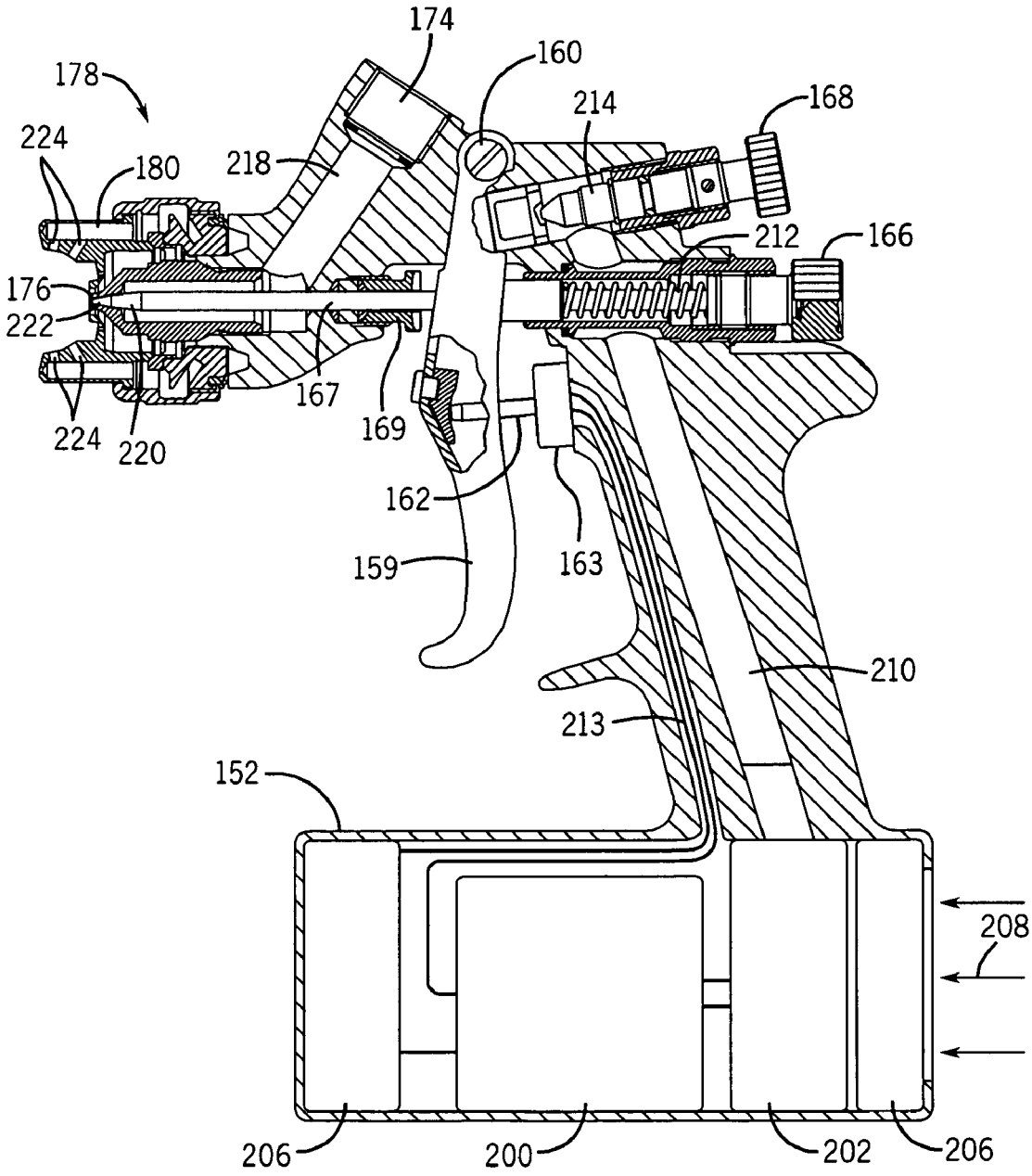
FIG. 4 is a cross section view of an embodiment of a spray coating device.

FIG. 4 is a cross section view of the spray gun 12 in accordance with an exemplary embodiment of the present technique. In the illustrated embodiment, the spray gun 12 includes on-board components enabling the cordless feature of the spray gun 12. As illustrated, the enclosure 152 houses a motor 200 coupled to an air blower 202 and battery 204. Those skilled in the art will appreciate that the motor 200 may be a constant speed motor or a variable speed drive motor controlled by the trigger 159. In addition, the enclosure 152 houses an air filter 206 disposed in a rear portion of the enclosure 152 adjacent to the blower 202. As further illustrated, the motor 200 is disposed between the battery 204 and the blower 202. The battery 204 may be a rechargeable battery adapted to store energy for powering the motor 200. Alternatively, the battery 204 may be a non-rechargeable battery, such as those adapted to provide standard 24 volts. The battery 204 may include electrical interfaces for receiving external power, such as the power provided by the docking station/separate charger 150, as described hereinabove. Further, the motor 202 is adapted to drive the blower 202, which in turn is adapted to draw air into the spray gun 12 from the outside, as indicated by arrows 208. The air filter 206 is adapted to filter/clean the incoming air, thereby preventing large dust and/or other particles from entering the spray gun 12. This may preserve and promote a longer lifetime of the motor 200 and the spray gun 12. In addition, the filter 206 blocks undesirable particles from mixing with the coating fluid, the spray, and the coating produced by the spray. In some embodiments, the air filter 206 may include multiple stages and/or types of air filtration.

Hence, the on-board air blower 202 is adapted to stabilize and provide a desired amount of air flow to the spray gun 12. The air blower 202 further provides stable amounts of air so as to maintain air pressure within the spray gun 12 at a desired level. In this manner, the on-board blower 202 provides for a self sustained air system that eliminates incorporating on-board air tanks, air canisters and the like for stabilizing the air pressure within the spray gun 12. By eliminating such stabilizing/balancing on-board air canisters, the construction of the spray gun 12 may be simplified and the spray gun 12 may be less cumbersome to handle during operation. The spray gun 12 may include additional air and pressure controlling mechanisms. These may include air valve modules that include, for example, air valves, fan controls and modular connectors adapted to deliver air from the blower 202 to the upper portion of the spray gun 12. Further, such valves and modular connectors may be adapted to deliver pressurized air to exit tip 176. The pressurized air delivered to exit tip 176 may also be fed into an atomization and fluid break up mechanism, which optimizes atomization of the coating formed when the spraying fluid exits spray gun 12. Further, such air flow regulating mechanisms may ensure that proper amounts of air and coating fluid are mixed within the spray gun 12 to form a spray coating having a desirable spraying profile.

Further, the spray gun 12 includes an air channel 210 extending from the blower 202 to an upper part of the spray gun 12. The air channel 210 is adapted to route or channel the incoming air drawn by the blower 202 into the upper portion of the spray gun 12. Once the incoming air reaches the upper portion of the spray gun 12, it mixes with the spray fluid and, thereafter, exits the tip 176 to form a uniform spray coating. As further illustrated by FIG. 4, the fluid needle valve 167 extends from the needle adjusting screw 166 to the spray tip 176. A spring 212 is disposed along a rear portion of the fluid needle valve 167. As illustrated, one end of the spring 212 abuts a portion of the fluid needle valve 167, while the other end of the spring 212 abuts the needle adjusting screw 166. The spring 212 is adapted to provide a biasing force opposite to a force that the user applies when actuating the trigger 159. The needle adjusting screw 166 may be rotatably adjusted so as to correspondingly adjust movement of the fluid needle valve 167 for opening and/or closing the exit tip 176. The fluid needle valve 167 is also coupled to the trigger 159. Thus, as trigger 159 is rotated about pivot joint 160, the fluid needle valve 167 is adapted to move inwardly away from fluid exit tip 176. In this manner, trigger 159 can open and close fluid needle valve 167, thereby controlling fluid flow through the spray gun 12.

As further illustrated, the spray gun 12 includes a valve 214 disposed between the spreader adjusting screw 168 and a stop 216. The valve 214 may comprise an air valve or regulator to adjust air flow through the spray gun 12 to the head 178. As further illustrated, the switch 163 is coupled to the motor 200 and the battery 204 via wires 213. The wires 213 are adapted to close or open a circuit existing between the switch 163, the motor 200, and the battery 204.

As mentioned above, the spray gun 12 further includes the fluid inlet adapter 174 adapted to receive the fluid canister 170. The fluid inlet adapter 174 is coupled to a fluid channel 218 extending along the front portion 172 of the spray gun 12. The fluid channel 218 is adapted to route incoming coating fluid into the spray head 178. Further, exit tip 176 and air cap 180 may form a fluid delivery tip module that includes fluid breakup and fluid mixing components disposed within a central passage 220 of air cap 178. As further illustrated, the fluid needle valve 167 has a needle tip 222 adapted to move inwardly within passage 220, as the user engages the trigger 159. The desired spray fluid then flows through passage 220 and out through exit tip 176 to form a desired spray. The air cap 180 may further include an atomization mechanism formed by one or more spray shaping orifices 224, which force the spray to form a desired spray pattern (e.g., a flat spray). The spray gun 12 may also comprise a variety of other atomization mechanisms to provide a desired spray pattern and droplet distribution.

Figure 5:
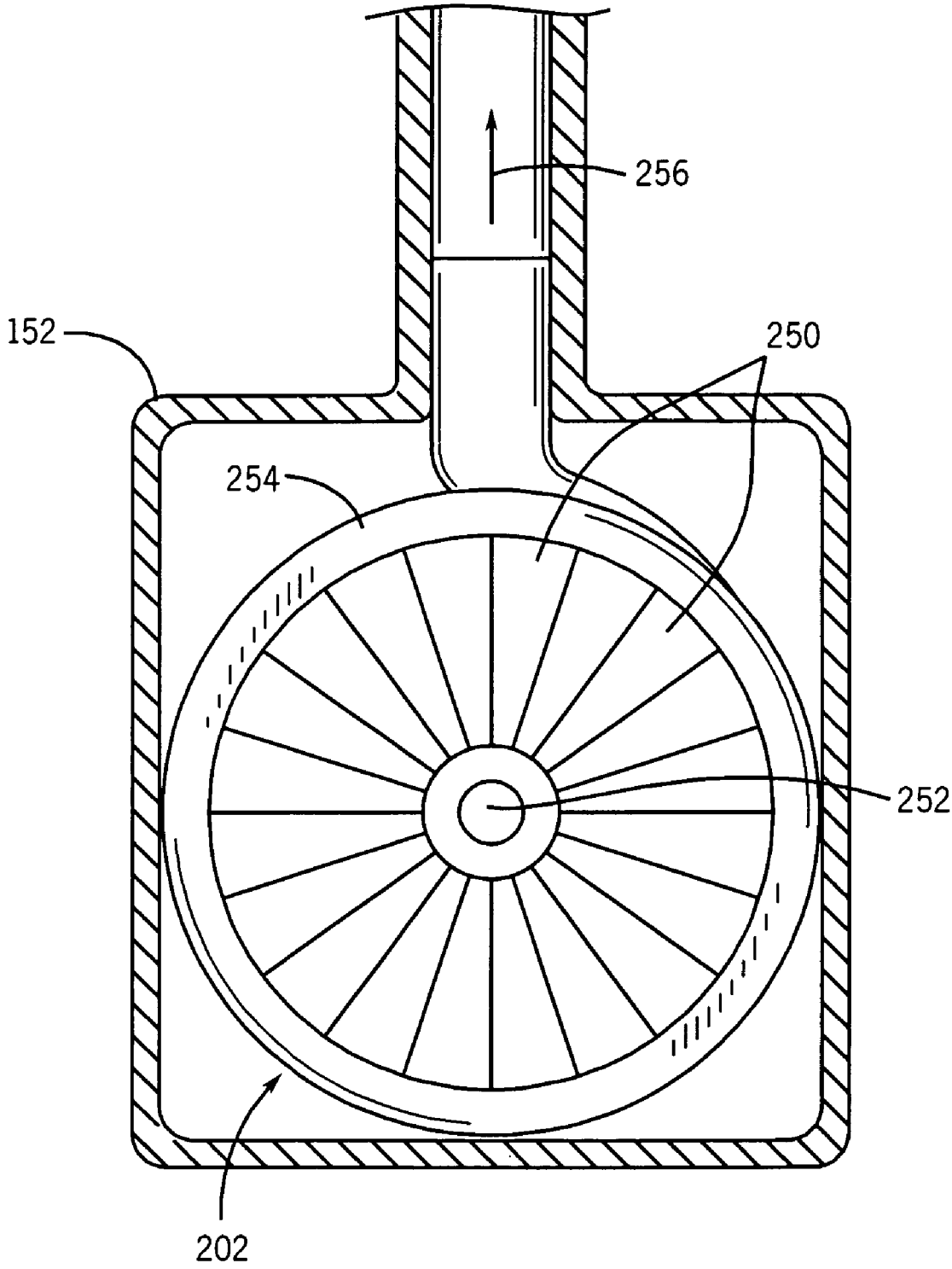
FIG. 5 is a front cross section view of an embodiment of a blower used with the spray coating device shown in FIGS. 3 and 4.

FIG. 5 is a front cross section view of an embodiment of the blower 202 used with the spray gun 12 shown in FIGS. 3 and 4. As illustrated, the blower 202 is housed within the enclosure 152. The blower 202 includes blades 250 disposed radially outward about central axis 252. The blades 252 may be made up from plastic, metal, ceramic, cement, hard rubber, and/or from mixtures of the aforementioned and/or of similar substances. In certain embodiments, the blades 252 are made of aluminum or another light weight metal. In other embodiments, the blades 252 are composite structures having a core and a coating made of different materials. For example, the blades 252 may have a metal core with a plastic exterior coating.

The outer boundaries of the blades 252 form a uniform outer circle 254. Each of the blades 252 may be slanted at an optimal angle with respect to the circle 254, so as to achieve a maximal air intake as the blades 252 rotate about central axis 252. For example, the blades 252 of the blower 202 may be slanted, whereby a counter clockwise rotation of the blades 252 causes outside air to stream inward towards the blades 252 and, to thereafter, flow through the air channel 210, as indicated by arrow 256. For example, the blower 202 may intake air in a first direction along the axis 252 (see arrows 208, FIG. 4), and then output the air in a second direction different from the first direction (see arrow 256, FIG. 5). In this embodiment, the first and second direction are generally transverse or crosswise (e.g., perpendicular) to one another. However, other embodiments may employ axial fans, radial screw compressors, and so forth.

As mentioned, the incorporation of the air blower 202 within the spray gun 12 supplies a proper and stable level of air pressure, which may otherwise be achievable by external unpressurized and/or pressurized air tanks/canisters. Accordingly, by virtue of including the onboard air blower 202, embodiments of the present technique eliminate a need for coupling on-board air stabilizing air tanks or devices to the spray gun 12. Again, the blower 202 is designed to provide uniform flow and pressure, e.g., without undesirable pressure pulses or fluctuations. Such pulses or fluctuations are typical for reciprocating compressors, such as those having a piston reciprocating up and down within a cylinder. In contrast, the blower 202, axial fans, and rotary screw compressors continuously rotate to flow, pressurize, and/or compress the air, thereby resulting in more stable flow without the pulses or fluctuations exhibited by reciprocating devices. For these reasons, the spray gun 12 does not require an air tank downstream of the blower 12, because the air tank is not needed to stabilize the air flow. As a result, the spray gun 12 may be more compact, lightweight, and less costly than a spray gun 12 having an air tank.

The blower 202 may be designed to provide a suitable air pressure or range of air pressures at least partially based on the blade angle, the tightness of the fit between the blades 250 and the blower housing, the speed of the motor 200, or a combination thereof. For example, the blower 202 may be designed to provide a high volume and low pressure output of air into the spray gun 12. In some embodiments, the blower 202 may output up to about 5, 10, 15, 20, 25, 30, or more psi of air pressure. The flow rate of the blower 202 may be up to about 100 cubic feet per minute. In some embodiments, the spray gun 12 may include a plurality of air blowers 202 arranged in series and/or parallel to one another. In some embodiments, the blower 202 may be replaced with one or more rotary screw compressors, axial fans, or other non-reciprocating/rotary type blowing/compressing mechanisms. For example, a rotary screw compressor may include a rotating shaft with helical screws or threads, which progressively force air into a smaller and smaller volume during rotation. For example, a rotary screw compressor may include either a single screw element or two counter rotating intermeshed helical screw elements housed within a specially shaped chamber. As such a mechanism rotates, the meshing and rotation of the two helical rotors produces a series of volume-reducing cavities. In this manner, gas is drawn in through an inlet port in a casing, captured in a cavity, compressed as the cavity reduces in volume, and then discharged through another port in the casing. These and other similar types of compressors may be incorporated within the blower 202 for generating sufficient desired air flow within the blower 202.

Figure 6:
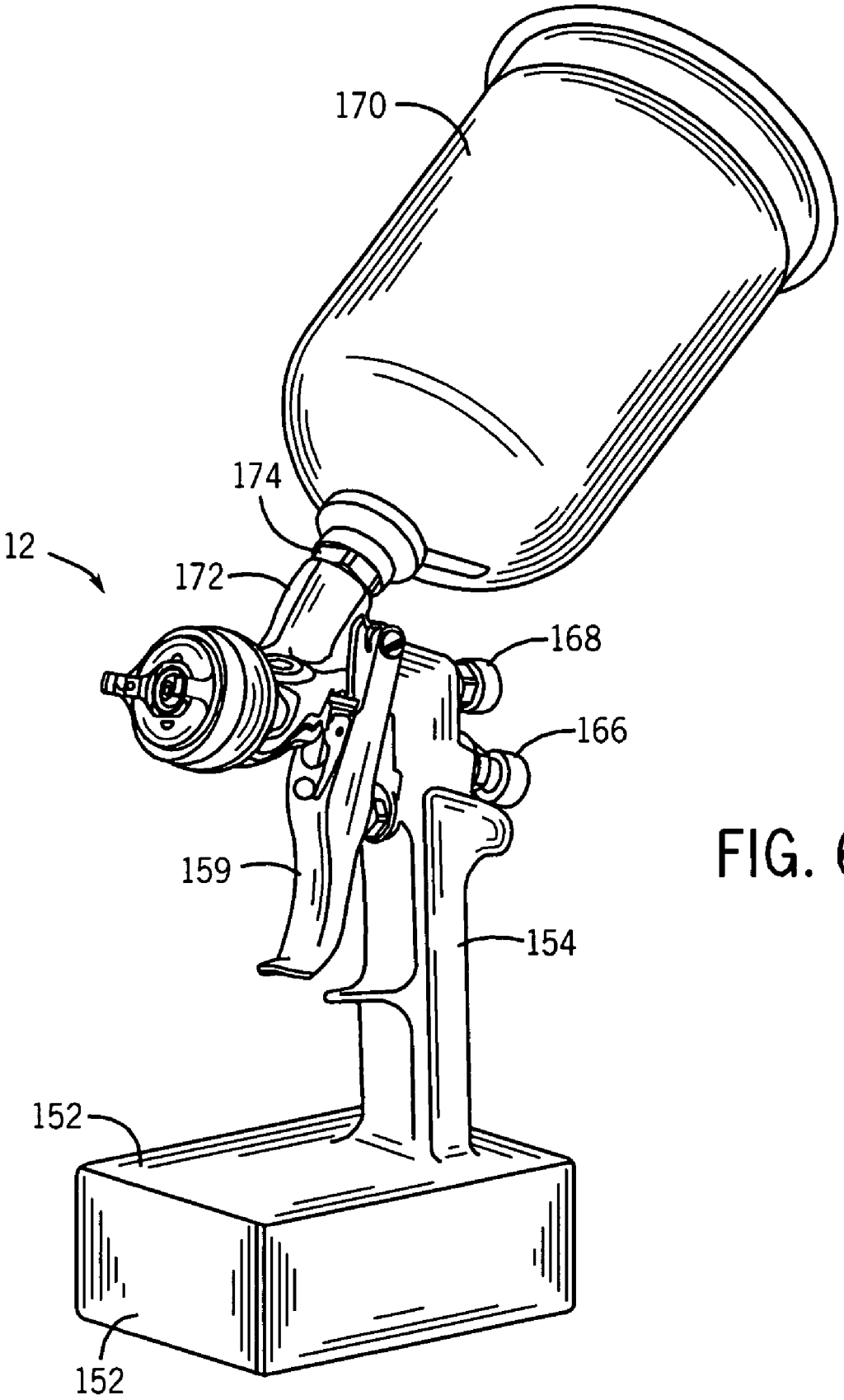
FIG. 6 is a perspective view of an embodiment of the spray coating device shown in FIGS. 4 and 5.

FIG. 6 is a perspective view of the spray gun 12 in accordance with an embodiment of the present technique. As illustrated, the spray gun 12 includes the paint cup 170 coupled to the spray gun 12 from above via fluid inlet adapter 174. As mentioned, this configuration corresponds to a gravity-assisted fluid-feeding mechanism, whereby the spray fluid drops into the spray gun 12. The paint cup 170 may include at its tip, for example, a thread adapted to rotationally couple to the fluid inlet adapter 174. In this manner, the user may easily screw the paint cup 170 into the spray gun 12 and, thereafter fasten the paint cup 170 using, for example, a nut coupled to the adapter 174. In this manner, the user may easily attach and/or detach the fluid tank from the spray gun 12.

As further illustrated, the enclosure 152 is disposed directly beneath handle 154, whereby the enclosure 152 does not extend forward far beyond the upper portion of the spray gun 12. This enables a more convenient handling of the spray gun 12 during spray coating operations. As is further illustrated by FIG. 6, the spray gun 12 is a relatively compact and self sustained cordless spray coating device. For example, upon exhausting the coating fluid contained with the spay tank 170, the user may exchange coating fluids contained in fluid tanks, similar to the fluid tank 170. Accordingly, the fluid tank replacement mechanism discussed above provides a user with an ability to efficiently replace and use different fluid tanks during and/or between the spray coating operations. By further example, the cordless feature of the spray gun 12 enables the user to recharge the spray gun 12 by replacing the battery 204 (see FIG. 4) or by placing the spray gun 12 on docking station 150 (see FIG. 3). Further, the user may be able to freely carry the spray gun 12, especially, during operation where the user may need to access and spray coat surfaces otherwise not accessible with conventional spray guns having cords attached thereto.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a spray coating device, comprising:

a spray gun comprising a spray head, a handle, a base enclosure coupled to the handle, and an air passage extending through the handle from the base enclosure to the spray head, wherein the handle is disposed between the spray head and the base enclosure; and an air flow generator disposed in the base enclosure, wherein the air flow generator comprises a battery, a motor driven by the battery, and a plurality of blades rotatable by the motor, wherein the plurality of blades is configured to force an air flow through the air passage.

2. The system of claim 1, comprising a liquid passage extending through the spray gun, wherein the liquid passage is configured to route a liquid flow to the spray head, the air passage is configured to route the air flow to the spray head, and the spray head comprises at least one air atomization port coupled to the air passage.

3. The system of claim 2, wherein the liquid passage and the air passage are separate from one another.

4. The system of claim 1, wherein the air flow generator comprises a blower having a plurality of blades configured to intake air in a first direction and to output air in a second direction, wherein the first and second directions are generally crosswise to one another.

5. The system of claim 1, wherein the air flow generator is configured to flow air directly through the spray gun without an air storage tank.

6. The system of claim 1, comprising a docking station configured to support the base enclosure of the spray gun, wherein the docking station comprises a battery charger configured to charge the battery disposed within the base enclosure, and the battery is a rechargeable battery.

7. The system of claim 1, comprising a gravity feed spray fluid tank directly coupled to the spray gun, wherein the spray head is configured to receive a gravity fed fluid flow from the gravity feed spray fluid tank.

8. The system of claim 1, wherein the spray coating device is cordless, hoseless, tankless, battery powered, and completely self-contained.

9. The system of claim 1, comprising a trigger coupled to the handle, an air valve coupled to the trigger, and a liquid valve coupled to the trigger.

10. A system, comprising:

a spray gun, comprising:

a body;

a spray head coupled to the body, wherein the spray head comprises a liquid port and an air port;

a handle coupled to the body, wherein the body is disposed between the spray head and the handle;

a trigger coupled to the handle;

a liquid valve coupled to the trigger, wherein the liquid valve is disposed along a liquid passage extending to the spray head; and a base enclosure coupled to the handle, wherein the handle is disposed between the body and the base enclosure, wherein the base enclosure comprises a battery, a motor driven by the battery, and a plurality of blades rotatable by the motor, wherein an air flow path extends from the base enclosure, through the handle, through the body, and into the spray head to the air port, wherein the plurality of blades is configured to force an air flow through the air flow path, wherein the trigger is coupled to a switch configured to enable and disable the motor.

11. The system of claim 10, comprising a blower having the plurality of blades configured to turn the air flow approximately 90 degrees.

12. The system of claim 10, wherein the air port comprises an air atomization port.

13. The system of claim 10, wherein the motor and battery are not disposed in the air flow path.

14. The system of claim 10, wherein the plurality of blades is rotatable about an axis of rotation, and the plurality of blades is configured to turn an air flow between one direction generally perpendicular to the axis of rotation and another direction generally parallel to the axis of rotation.

15. A system, comprising:

a spray gun, comprising:

a body;

a spray head coupled to the body, wherein the spray head comprises a liquid port and an air port, and the air port is configured to atomize or shape a liquid spray ejected from the liquid port;

a liquid passage extending to the liquid port;

an air passage extending to the air port;

a handle coupled to the body, wherein the body is disposed between the spray head and the handle;

a base enclosure coupled to the handle, wherein the handle is disposed between the body and the base enclosure, wherein the base enclosure comprises an air flow generator coupled to the air passage, wherein the air flow generator comprises a battery, a motor driven by the battery, and a plurality of blades rotatable by the motor, wherein the plurality of blades is configured to force an air flow through the air passage.

16. The system of claim 15, comprising a liquid valve disposed along the liquid passage, a switch coupled to the motor, and a trigger coupled to both the liquid valve and the switch.

17. The system of claim 15, wherein the air passage extends from the base enclosure, through the handle, through the body, and into the spray head to the air port.

18. The system of claim 17, wherein the motor is not disposed in the air passage.

19. The system of claim 15, wherein the plurality of blades is rotatable about an axis of rotation, and the plurality of blades is configured to turn the air flow between one direction generally perpendicular to the axis of rotation and another direction generally parallel to the axis of rotation.

20. A system, comprising:

a spray gun, comprising:

a body;

a spray head coupled to the body, wherein the spray head comprises a liquid port and an air port, and the air port is configured to atomize or shape a liquid spray ejected from the liquid port;

a liquid passage extending to the liquid port;

an air passage extending to the air port;

a handle coupled to the body, wherein the body is disposed between the spray head and the handle; and a base enclosure coupled to the handle, wherein the handle is disposed between the body and the base enclosure, wherein the base enclosure comprises an air flow generator coupled to the air passage, wherein the air flow generator comprises a motor coupled to a blower having a plurality of blades rotatable about an axis of rotation, the plurality of blades is configured to turn an air flow between one direction generally perpendicular to the axis of rotation and another direction generally parallel to the axis of rotation.

* * * * *